US011659875B2

(12) United States Patent
Hugenberg et al.

(10) Patent No.: US 11,659,875 B2
(45) Date of Patent: May 30, 2023

(54) FACE COVERING HAT ASSEMBLY

(71) Applicants: Chris Hugenberg, Shorewood, IL (US); Amy Hugenberg, Shorewood, IL (US)

(72) Inventors: Chris Hugenberg, Shorewood, IL (US); Amy Hugenberg, Shorewood, IL (US)

( * ) Notice: Subject to any disclaimer, the term of this patent is extended or adjusted under 35 U.S.C. 154(b) by 222 days.

(21) Appl. No.: 16/952,174

(22) Filed: Nov. 19, 2020

(65) Prior Publication Data

US 2022/0151315 A1 May 19, 2022

(51) Int. Cl.
*A41D 13/11* (2006.01)
*A42B 1/241* (2021.01)

(52) U.S. Cl.
CPC ..... *A41D 13/1161* (2013.01); *A42B 1/241* (2013.01)

(58) Field of Classification Search
CPC ..... A41D 13/1161; A41D 13/11; A41D 13/1153; A42B 1/24; A42B 1/241; A42B 1/0187
See application file for complete search history.

(56) References Cited

U.S. PATENT DOCUMENTS 1,331,701 A * 2/1920 Fendelman ..... A42B 1/0182 2/10
1,481,541 A * 1/1924 Douglas ..... A42B 1/0187 2/172
1,505,978 A * 8/1924 Stetson ..... A42B 1/06 2/6.1
2,462,258 A * 2/1949 Dannenberg ..... A42B 1/0182 2/10
2,472,033 A * 5/1949 Wetzel ..... A42B 1/014 2/4
3,292,182 A * 12/1966 Schuessler ..... A42B 1/06 2/173
3,307,202 A * 3/1967 Schuessler ..... A42B 1/06 2/173
D296,031 S * 6/1988 Coy ..... D2/866
5,035,004 A * 7/1991 Koester ..... G09F 21/02 2/9
5,062,163 A * 11/1991 Avey ..... A42B 1/0187 2/909
5,544,361 A 8/1996 Fine
5,933,871 A * 8/1999 Kraft ..... A42B 1/24 2/209.13
7,240,372 B2 * 7/2007 Larson ..... A41D 13/11 2/173

(Continued)

FOREIGN PATENT DOCUMENTS

WO WO9622033 7/1996

*Primary Examiner* — F Griffin Hall

(57) ABSTRACT

A face covering hat assembly for includes a hat for wearing on a user's head. The hat has a head portion and a flap that is coupled to the head portion. The flap is positionable in an exposing position having the head portion is exposed. A mask is provided for wearing on a user's face such that the mask covers the user's mouth and the user's nose. The mask is storable between the flap and the head portion of the hat when the mask in not is worn. A pair of first straps is each coupled to the mask and each of the first straps is releasably matable to the flap. A pair of second straps is each coupled to the mask and each of the second straps is extendable around then user's neck when the mask is worn.

8 Claims, 8 Drawing Sheets

(56) References Cited

U.S. PATENT DOCUMENTS

| | | | | |
|---|---|---|---|---|
| 7,681,251 | B2 | 3/2010 | Carey | |
| D641,961 | S | 7/2011 | Kim | |
| 9,439,466 | B2 * | 9/2016 | Woo | A41D 15/00 |
| 9,894,952 | B2 | 2/2018 | Hayes | |
| 10,609,977 | B1 * | 4/2020 | Stir | A42B 1/206 |
| 10,687,569 | B1 * | 6/2020 | McDirmid | A42B 3/20 |
| 11,259,579 | B2 * | 3/2022 | Powell | A42B 7/00 |
| 11,357,273 | B2 * | 6/2022 | Cloyd | A41D 13/1161 |
| 11,369,154 | B2 * | 6/2022 | Hernandez | A42B 1/24 |
| 2006/0070160 | A1 * | 4/2006 | Reitz | A42B 1/24 2/9 |
| 2008/0028497 | A1 * | 2/2008 | Hayes | A42B 1/0187 2/171 |
| 2009/0151049 | A1 * | 6/2009 | Conrardy | A42B 1/0187 2/206 |
| 2013/0305431 | A1 | 11/2013 | Mraz | |
| 2015/0057621 | A1 * | 2/2015 | Coombs | A42B 1/18 604/289 |
| 2016/0073720 | A1 | 3/2016 | Niedrich | |
| 2017/0055597 | A1 * | 3/2017 | Lekven | A41D 13/1161 |
| 2019/0059492 | A1 * | 2/2019 | Grammer | A42B 1/0188 |
| 2020/0093212 | A1 * | 3/2020 | Zheng | A42B 1/24 |
| 2020/0187579 | A1 * | 6/2020 | Babalola | A42B 1/247 |
| 2020/0390177 | A1 * | 12/2020 | Garmon | A42B 1/04 |
| 2021/0345694 | A1 * | 11/2021 | Volk | A41D 13/1161 |

* cited by examiner

FACE COVERING HAT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to face covering devices and more particularly pertains to a new face covering device for facilitating a user to wear a mask while wearing a hat. The face covering device facilitates the hat to be worn with or without the mask being worn. Moreover, the hat includes a storage area to store the mask when the mask is not being worn.

(2) Description of Related Art Including Information Disclosed Under 37 CFR 1.97 and 1.98

The prior art relates to face covering devices including a variety of hats which have a face mask being integrated therein for covering a user's face. The prior art also discloses a variety of hats that include a face mask that is removably attachable to the hat and which pivotable on the hat. In no instance does the prior art disclose a hat that includes a storage pouch being integrated therein and a face mask that is attachable to the hat for covering a user's face and which can be stored in the storage pouch.

BRIEF SUMMARY OF THE INVENTION

An embodiment of the disclosure meets the needs presented above by generally comprising a hat for wearing on a user's head. The hat has a head portion and a flap that is coupled to the head portion. The flap is positionable in an exposing position having the head portion is exposed. A mask is provided for wearing on a user's face such that the mask covers the user's mouth and the user's nose. The mask is storable between the flap and the head portion of the hat when the mask in not is worn. A pair of first straps is each coupled to the mask and each of the first straps is releasably matable to the flap. A pair of second straps is each coupled to the mask and each of the second straps is extendable around then user's neck when the mask is worn.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
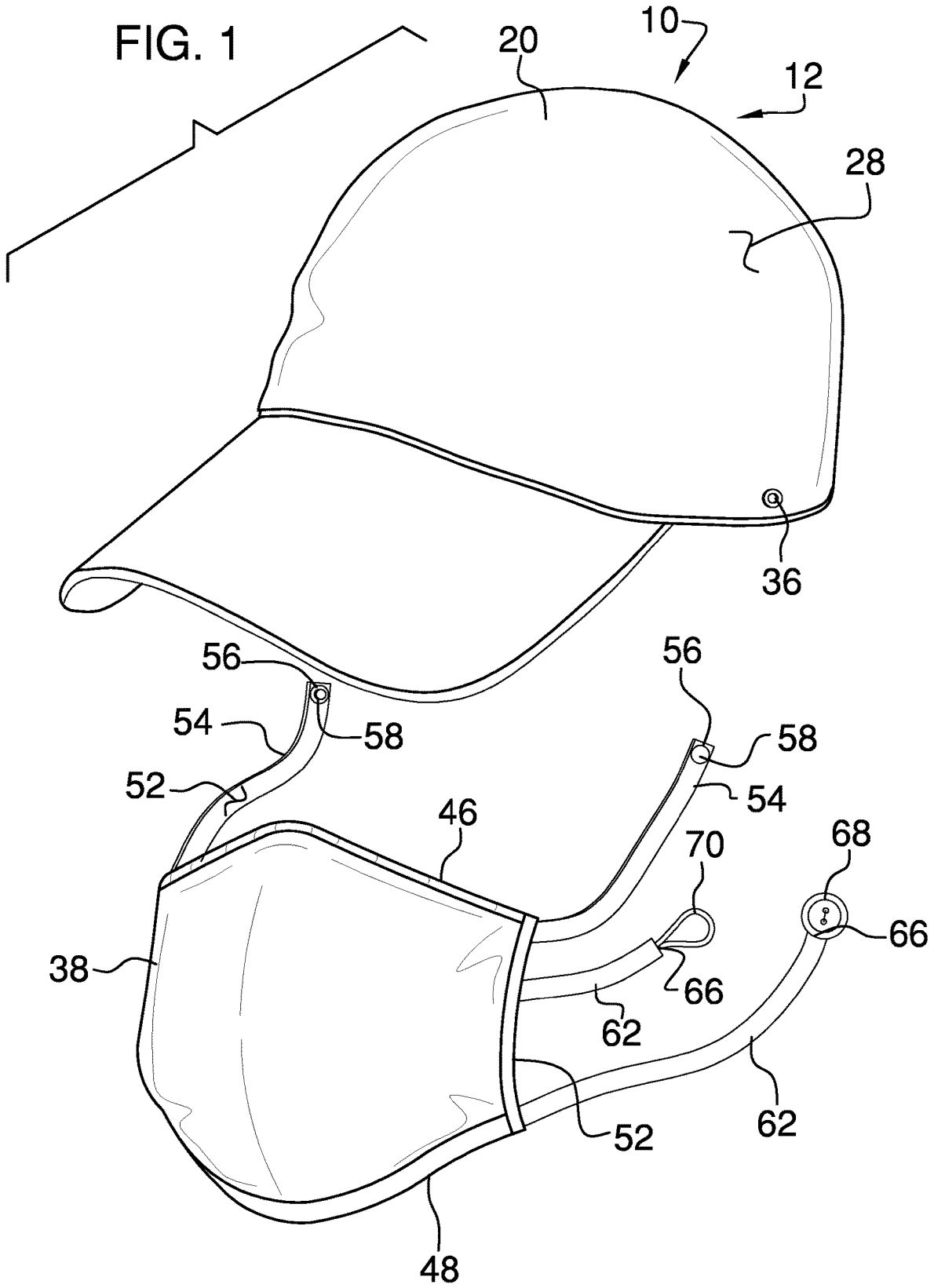
FIG. 1 is a perspective view of a face covering hat assembly according to an embodiment of the disclosure.
Figure 2:
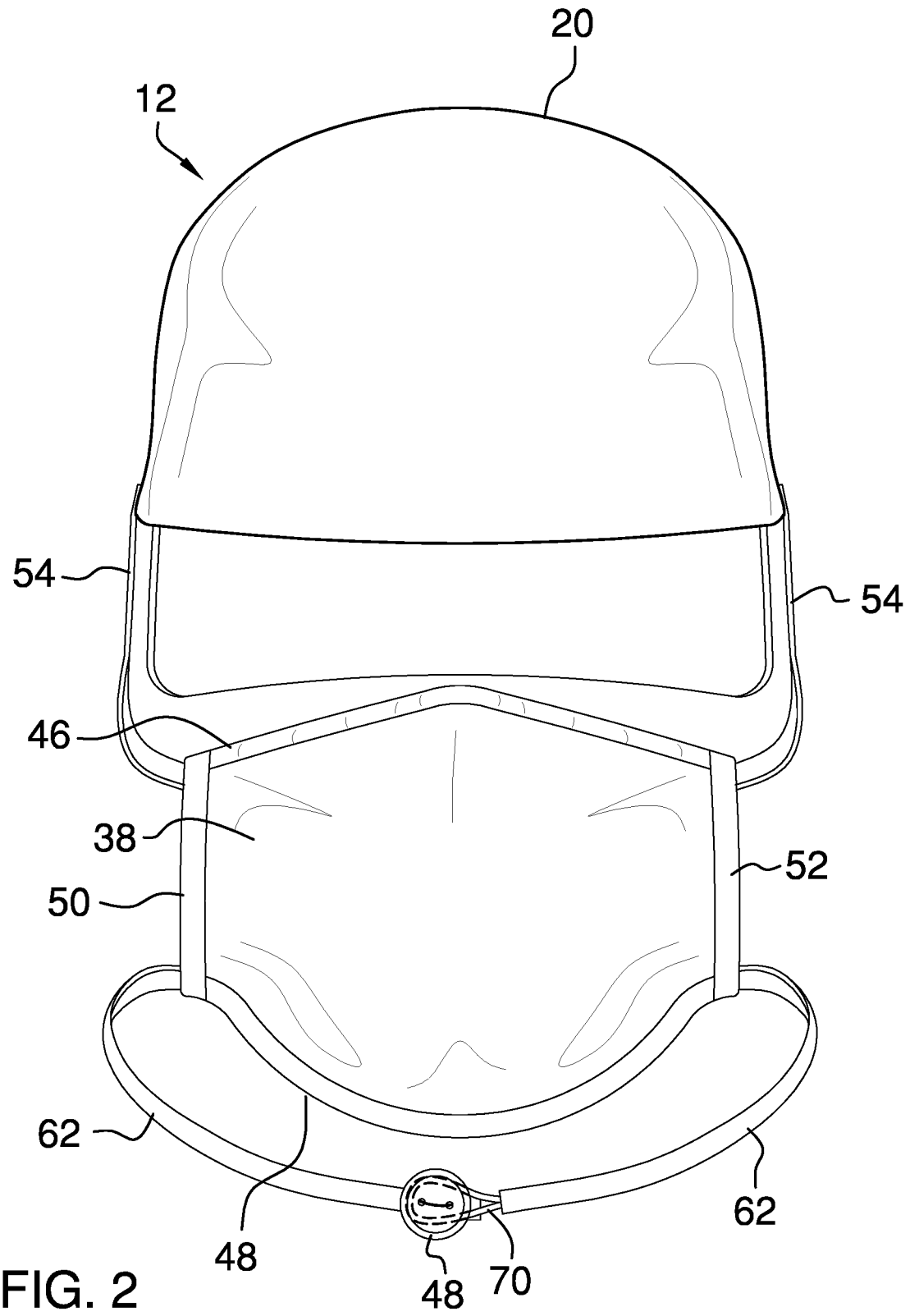
FIG. 2 is a back view of an embodiment of the disclosure.
Figure 3:
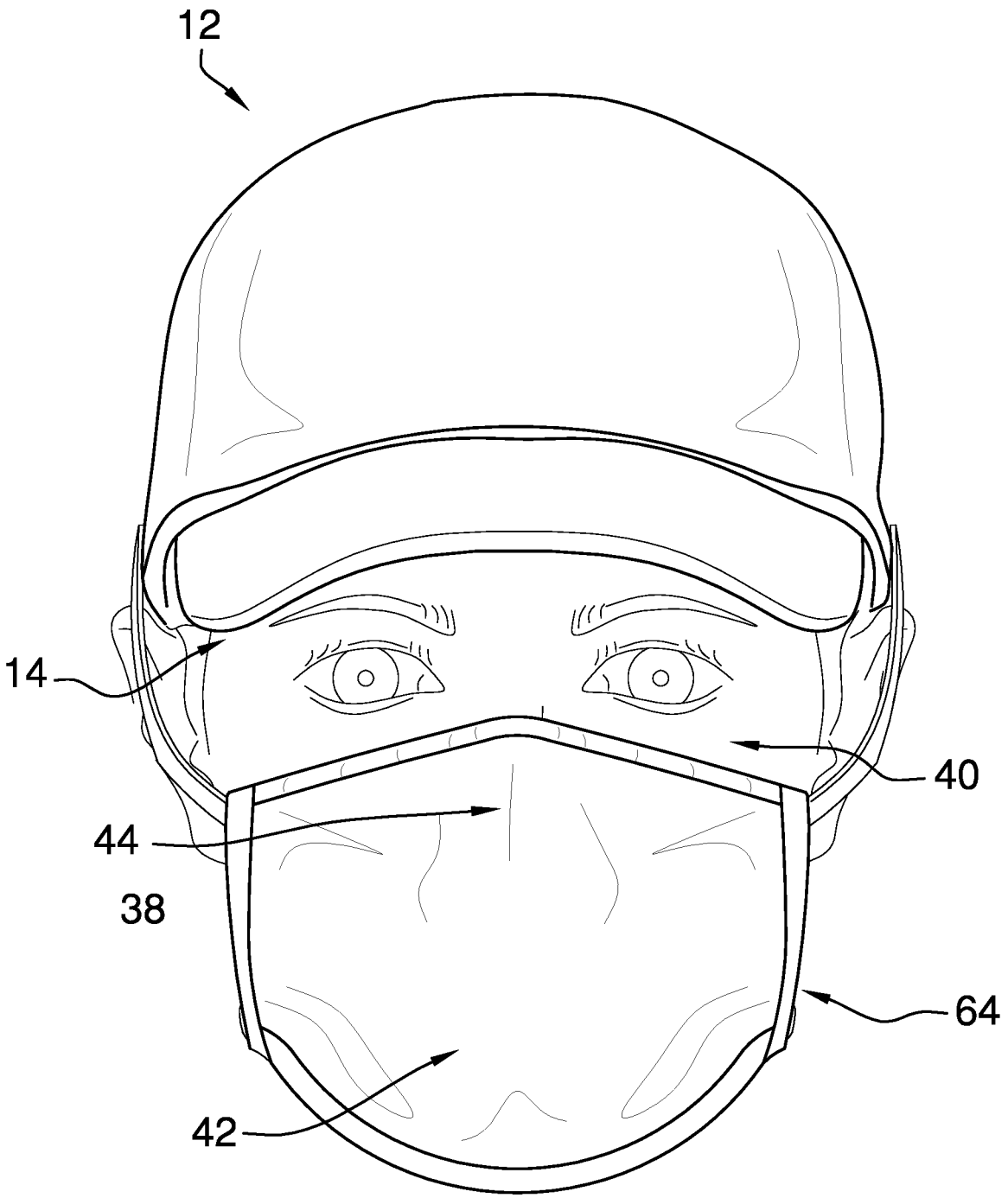
FIG. 3 is a front in-use view of an embodiment of the disclosure.
Figure 4:
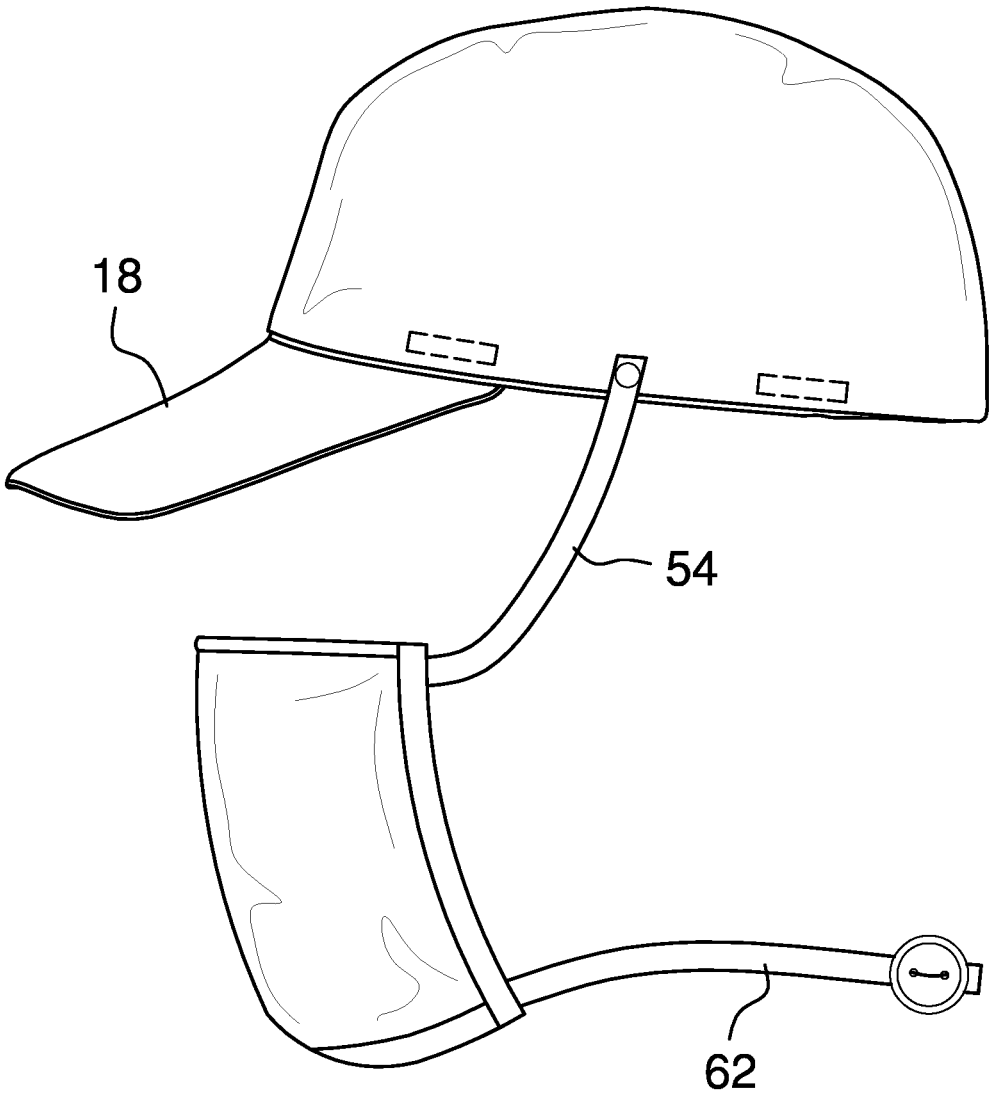
FIG. 4 is a left side view of an embodiment of the disclosure.
Figure 5:
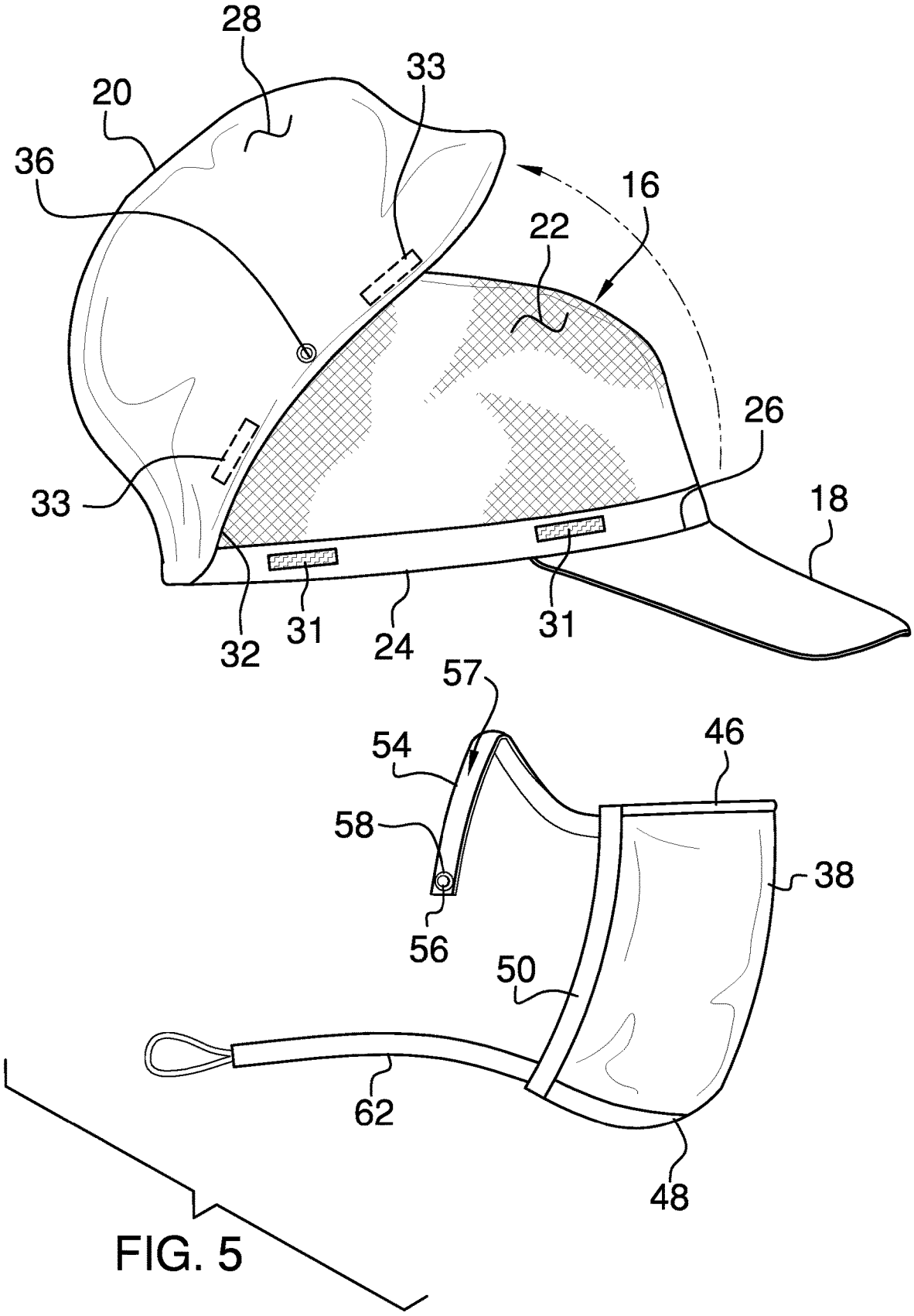
FIG. 5 is a right view of an embodiment of the disclosure showing a flap in an exposing position.
Figure 6:
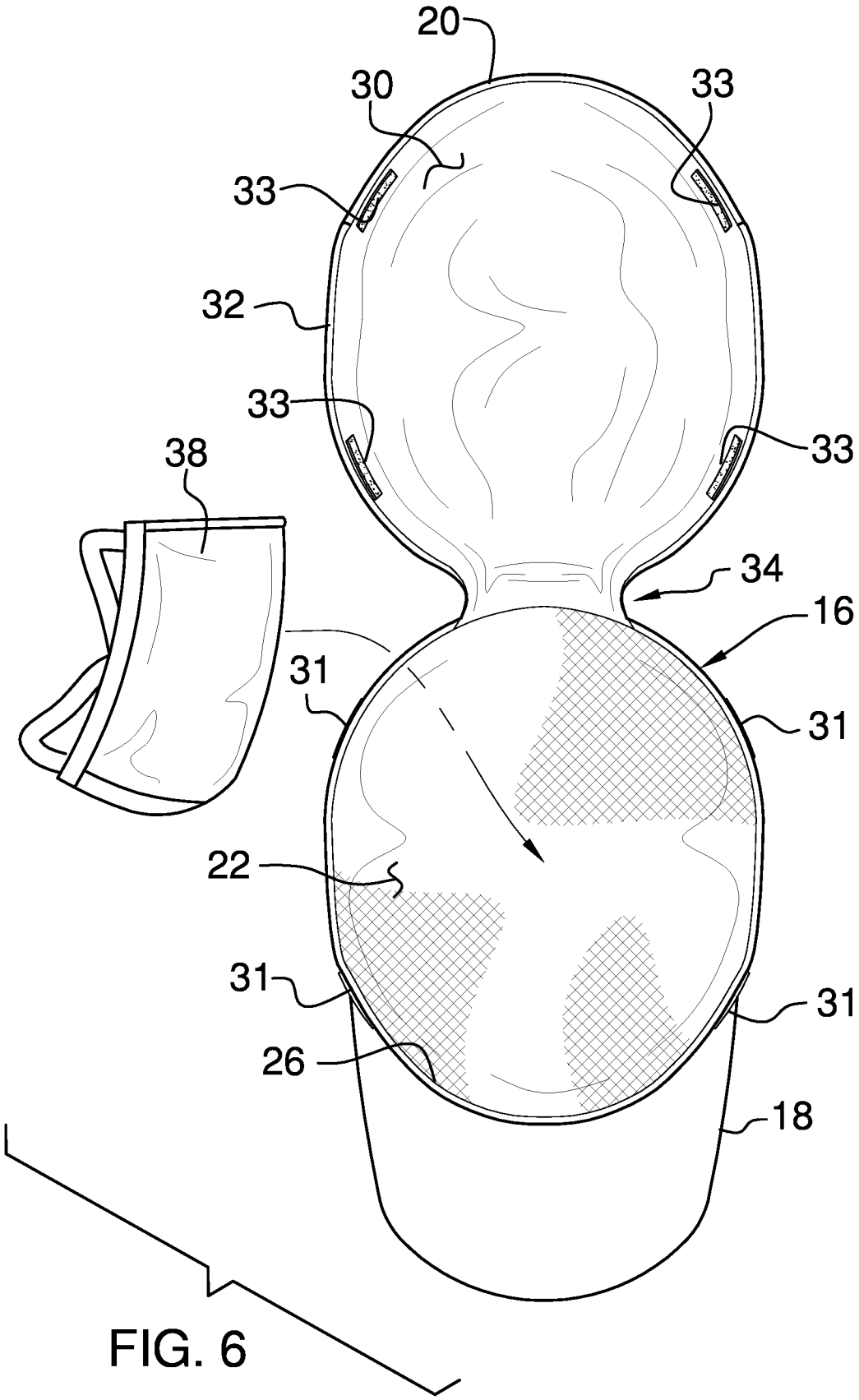
FIG. 6 is a top view of an embodiment of the disclosure showing a flap in an exposing position.

With reference now to the drawings, and in particular to FIGS. 1 through 8 thereof, a new face covering device embodying the principles and concepts of an embodiment of the disclosure and generally designated by the reference numeral 10 will be described.

As best illustrated in FIGS. 1 through 8, the face covering hat assembly 10 generally comprises a hat 12 that can be worn on a user's head 14. The hat 12 has a head portion 16 and a brim 18 that is coupled to the head portion 16. Moreover, the head portion 16 cover the user's head 14 having the brim 18 portion extending forwardly from the user's head 14 when the hat 12 is worn. The hat 12 has a flap 20 that is coupled to the head portion 16 and the flap 20 is positionable in a covering position having the flap 20 covering the head portion 16. The flap 20 is positionable in an exposing position having the head portion 16 being exposed.

The head portion 16 has a top surface 22 and a perimeter edge 24, and the top surface 40 22 is concavely arcuate with respect to the perimeter edge 24 such that the head portion 16 forms a bowl to fit over the user's head 14. The brim 18 has a rear edge 26 and the rear edge 26 is coupled to the perimeter edge 24 having the brim 18 extending forwardly from the head portion 16. The flap 20 has an outer surface 28, an inner surface 30 and a bottom edge 32 extending therebetween. The inner surface 30 is concavely arcuate with respect to the bottom edge 32 such that the flap 20 forms a bowl.

The bottom edge 32 is coupled to the perimeter edge 24 of the head portion 16 at an attachment point 34 extending partially around each of the perimeter edge 24 and the bottom edge 32. Additionally, the attachment point 34 is positioned on an opposite side of the perimeter edge 24 with respect to the brim 18. The inner surface 30 of the flap 20 rests on the top surface 22 of the head portion 16 having the bottom edge 32 being aligned with the perimeter edge 24 when the flap 20 is positioned in the covering position. Additionally, the head portion 16 is comprised of a mesh material wherein the head portion 16 is configured to pass air therethrough.

A plurality of first mating members 31 is each attached to the top surface 24 of the head portion 16 and the first mating members 31 are spaced apart from each other and are distributed around the perimeter edge 24. A plurality of second mating members 33 is each attached to the inner surface 30 of the flap 20 and the second mating members 33 are distributed around the bottom edge 32 of the flap. Each of the second mating members 33 is releasably matable to a respective one of the first mating members 31 when the flap 20 is positioned in the covering position to retain the flap 20 in the covering position. Each of the first mating members 31 and the second mating members 33 may comprise a hook and loop fastener or the like.

A pair of first fasteners 36 is each coupled to the outer surface 28 of the flap 20, and each of the first fasteners 36 is positioned adjacent to the bottom edge 32. Each of first fasteners 36 is positioned on opposite sides of the flap 20 with respect to each other. A mask 38 is provided that can be worn on a user's face 40 such that the mask 38 covers the user's mouth 42 and the user's nose 44. Moreover, the mask 38 is comprised of an air permeable material to facilitate the user to breathe with the mask 38 is being worn. The mask 38 is storable between the flap 20 and the head portion 16 of the hat 12 when the mask 38 in not is worn. The mask 38 has an upper edge 46, a lower edge 48, a first lateral edge 50 and a second lateral edge 52.

A pair of first straps 54 is each of the first straps 54 is coupled to and extends away from the mask 38. Each of the first straps 54 is releasably matable to the flap 20 when the hat 12 being is being worn. In this way the first straps 54 retain the mask 38 on the user's face 40. Each of the first straps 54 is positioned at an intersecting between the upper edge 46 and a respective one of the first lateral edge 50 and the second lateral edge 52 of the mask 38, and each of the first straps 54 has a distal end 56 with respect to the mask 38 and a first surface 57.

A pair of second fasteners 58 is each coupled to the first surface 40 of a respective one of the first straps 54 and each of the second fasteners 58 is positioned adjacent to the distal end 56 of the respective first strap 54. Each of the second fasteners 58 releasably engages a respective one of the first fasteners 36 on the flap 20 portion of the hat 12 having the first straps 54 angling upwardly along a respective side of the user face 40. Each of the first fasteners 36 and the second fasteners 58 may comprise a snap, a hook and loop fastener or other types of complementary, releasable fastener.

A pair of second straps 62 is each coupled to and extends away from the mask 38 to extend around then user's neck 64 when the mask 38 is worn. Each of the second straps 62 is matable to each other having the pair of second straps 62 forming a closed loop with the mask 38. In this way the mask 38 is retained on the user's face 40 when the hat 12 is worn. Each of the second straps 62 is positioned at an intersection between the lower edge 48 and a respective one of the first lateral edge 50 and the second lateral edge 52 of the mask 38, and each of the second straps 62 has a distal end 66 with respect to the mask 38.

A button 68 is coupled to the distal end 64 of a respective one of the second straps 62. A loop 70 is coupled to the distal end 64 of a respective one of the second straps 62 such that the loop 70 forms a closed loop 70 on the respective second strap 62. Moreover, the button 68 is extendable through the loop 70 for mating the second straps 62 together.

Figure 7:
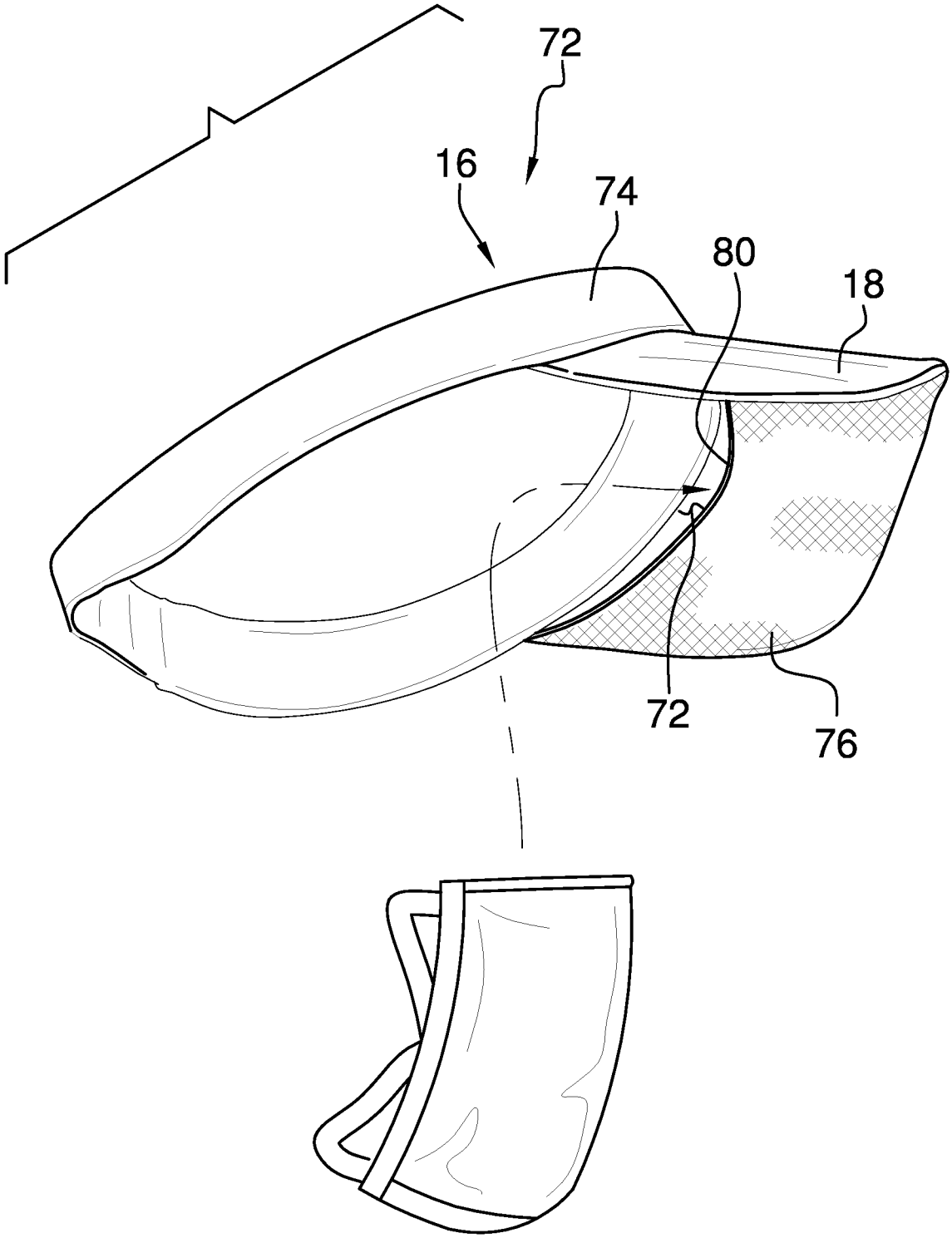
FIG. 7 is a perspective view of an alternative embodiment of the disclosure.

In an alternative embodiment 72 as is most clearly shown in FIG. 7, the head portion 16 of the hat 12 comprises a band 74 that can be extended around the user' head 14. A mesh panel 76 is coupled to a bottom surface 78 of the brim 18 and the mesh panel 76 has a first edge 80 that is uncoupled from the bottom surface 78 of the brim 18 such that the mesh panel 76 forms a pocket for storing the mask 38.

Figure 8:
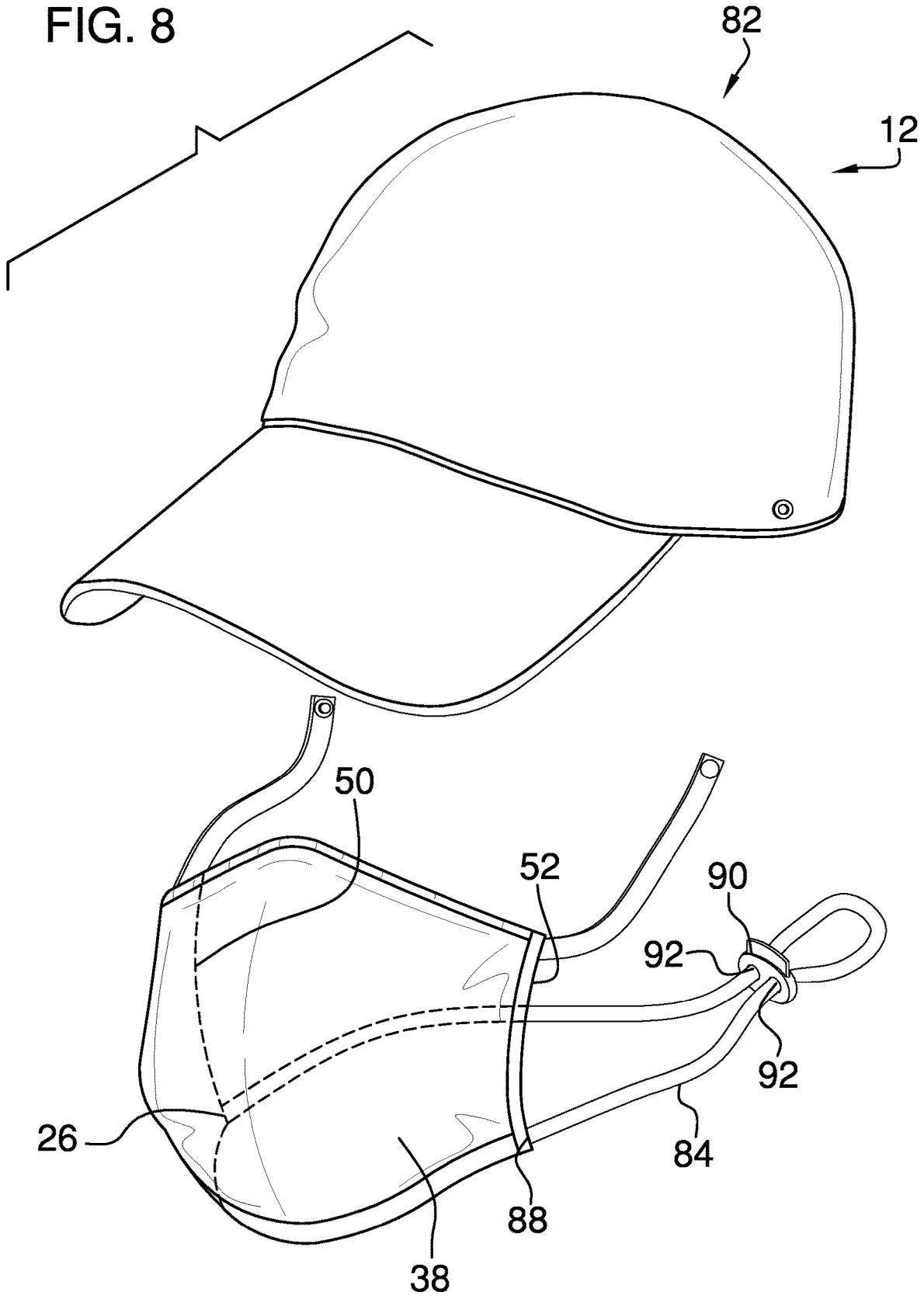
FIG. 8 is a front perspective view of an alternative embodiment of the disclosure.

In an alternative embodiment 82 as is most clearly shown in FIG. 8, a neck strap 84 has a first end 86 and a second end 88, and each of the first end 86 and the second end 88 of the neck strap 84 is coupled to an intersection between the lower edge 48 and a respective one of the first lateral edge 50 and the second lateral edge 52 of the mask 38 such that the neck strap 84 forms a closed loop 70 with respect to the mask 38 for wearing around the user's neck 64. Continuing in the alternative embodiment 82, an adjuster 90 is provided that has a pair of holes 92 each extending therethrough and the neck strap 84 extends through each of the holes 92. The adjuster 90 is slidable on the neck strap 84 for adjusting a diameter of the closed loop formed between the neck strap 84 and the mask 38. In this was the adjuster 90 facilitates the neck strap 84 to accommodate a variety of sizes of necks.

In use, each of the second fasteners 58 is coupled to the respective first fastener 36 to attach the mask 38 to the hat 12. The hat 12 is worn and the mask 38 is positioned on the user's face 40. Each of the second straps 62 is wrapped around the user's neck 64 and the button 68 is extended through the loop 70 to retain the second straps 62 around the user's neck 64. In this way the user can conform to face mask requirements during pandemics. The face mask can be stored beneath the flap 20 and the hat 12 can be worn in the typical convention of wearing hats.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A face covering hat assembly for removably attaching a facemask to a hat for inhibiting transmission of infectious diseases, said assembly comprising:

a hat being configured to be worn on a user's head, said hat having a head portion and a brim being coupled to said head portion wherein said head portion is configured to cover the user's head having said brim portion extending forwardly from the user's head when said hat is worn, said hat having a flap being coupled to said head portion, said flap being positionable in a covering position having said flap covering said head portion, said flap being positionable in an exposing position having said head portion being exposed;

a mask being configured to be worn on a user's face such that said mask covers the user's mouth and the user's nose, said mask being comprised of an air permeable material wherein said mask is configured to facilitate the user to breathe with said mask is being worn, said mask being storable between said flap and said head portion of said hat when said mask in not being worn on the user's face;

a pair of first straps, each of said first straps being coupled to and extending away from said mask, each of said first straps being releasably matable to said flap when said hat is being worn wherein said mask is configured to be retained on the user's face;

a pair of second straps, each of said second straps being coupled to and extending away from said mask wherein each of said second straps is configured to extend around a user's neck when said mask is worn, each of said second straps being matable to each other having said pair of second straps forming a closed loop with said mask;

wherein said head portion has a top surface and a perimeter edge, said top surface being concavely arcuate with respect to said perimeter edge such that said head portion forms a bowl wherein said head portion is configured to fit over the user's head, said brim having a rear edge, said rear edge being coupled to said perimeter edge having said brim extending forwardly from said head portion; and wherein said flap has an outer surface, an inner surface and a bottom edge extending therebetween, said inner surface being concavely arcuate with respect to said bottom edge such that said flap forms a bowl, said bottom edge being coupled to said perimeter edge of said head portion at an attachment point extending partially around each of said perimeter edge and said bottom edge, said attachment point being positioned on an opposite side of said perimeter edge with respect to said brim, said inner surface of said flap resting on said top surface of said head portion having said bottom edge being aligned with said perimeter edge when said flap is positioned in said covering position.

2. The assembly according to claim 1, further comprising a pair of first fasteners, each of said first fasteners being coupled to said outer surface of said flap, each of said first fasteners being positioned adjacent to said bottom edge, each of first fasteners being positioned on opposite sides of said flap with respect to each other.

3. The assembly according to claim 1, wherein:

said mask has an upper edge, a lower edge, a first lateral edge and a second lateral edge; and each of said first straps is positioned at an intersection between said upper edge and a respective one of said first lateral edge and said second lateral edge of said mask, each of said first straps having a distal end with respect to said mask and a first surface.

4. The assembly according to claim 3, further comprising:

a pair of first fasteners, each of said first fasteners being coupled to said flap portion of said hat; and a pair of second fasteners, each of said second fasteners being coupled to said first surface of a respective one of said first straps, each of said second fasteners being positioned adjacent to said distal end of said respective first strap, each of said second fasteners releasably engaging a respective one of said first fasteners on said flap portion of said hat wherein each of said first straps is configured to angle upwardly along a respective side of said user's face.

5. The assembly according to claim 1, wherein:

said mask has an upper edge, a lower edge, a first lateral edge and a second lateral edge; and each of said second straps is positioned at an intersection between said lower edge and a respective one of said first lateral edge and said second lateral edge of said mask, each of said second straps having a distal end with respect to said mask.

6. The assembly according to claim 5, further comprising a button being coupled to said distal end of a respective one of said second straps.

7. The assembly according to claim 6, further comprising a loop being coupled to said distal end of a respective one of said second straps such that said loop forms a closed loop on said respective second strap, said loop having said button being extendable therethrough for mating said second straps together.

8. A face covering hat assembly for removably attaching a facemask to a hat for inhibiting transmission of infectious diseases, said assembly comprising:

a hat being configured to be worn on a user's head, said hat having a head portion and a brim being coupled to said head portion wherein said head portion is configured to cover the user's head having said brim portion extending forwardly from the user's head when said hat is worn, said hat having a flap being coupled to said head portion, said flap being positionable in a covering position having said flap covering said head portion, said flap being positionable in an exposing position having said head portion being exposed, said head portion having a top surface and a perimeter edge, said top surface being concavely arcuate with respect to said perimeter edge such that said head portion forms a bowl wherein said head portion is configured to fit over the user's head, said brim having a rear edge, said rear edge being coupled to said perimeter edge having said brim extending forwardly from said head portion, said flap having an outer surface, an inner surface and a bottom edge extending therebetween, said inner surface being concavely arcuate with respect to said bottom edge such that said flap forms a bowl, said bottom edge being coupled to said perimeter edge of said head portion at an attachment point extending partially around each of said perimeter edge and said bottom edge, said attachment point being positioned on an opposite side of said perimeter edge with respect to said brim, said inner surface of said flap resting on said top surface of said head portion having said bottom edge being aligned with said perimeter edge when said flap is positioned in said covering position, said head portion being comprised of a mesh material Wherein said head portion is configured to pass air therethrough;

a pair of first fasteners, each of said first fasteners being coupled to said outer surface of said flap, each of said first fasteners being positioned adjacent to said bottom edge, each of first fasteners being positioned on opposite sides of said flap with respect to each other;

a mask being configured to be worn on a user's face such that said mask covers the user's mouth and the user's nose, said mask being comprised of an air permeable material Wherein said mask is configured to facilitate the user to breathe with said mask is being worn, said mask being storable between said flap and said head portion of said hat when said mask in not being worn on the user's face, said mask having an upper edge, a lower edge, a first lateral edge and a second lateral edge;

a pair of first straps, each of said first straps being coupled to and extending away from said mask, each of said first straps being releasably matable to said flap when said hat is being worn wherein said mask is configured to be retained on the user's face, each of said first straps being positioned at an intersection between said upper edge and a respective one of said first lateral edge and said second lateral edge of said mask, each of said first straps having a distal end with respect to said mask and a first surface;

a pair of second fasteners, each of said second fasteners being coupled to said first surface of a respective one of said first straps, each of said second fasteners being positioned adjacent to said distal end of said respective first strap, each of said second fasteners releasably engaging a respective one of said first fasteners on said flap portion of said hat wherein each of said first straps is configured to angle upwardly along a respective side of said user face;

a pair of second straps, each of said second straps being coupled to and extending away from said mask wherein each of said second straps is configured to extend around a user's neck when said mask is worn, each of said second straps being matable to each other having said pair of second straps forming a closed loop with said mask, each of said second straps being positioned at an intersection between said lower edge and a respective one of said first lateral edge and said second lateral edge of said mask, each of said second straps having a distal end with respect to said mask;

a button being coupled to said distal end of a respective one of said second straps; and a loop being coupled to said distal end of a respective one of said second straps such that said loop forms a closed loop on said respective second strap, said loop having said button being extendable therethrough for mating said second straps together.

* * * * *